United States Patent [19]

Mangum

[11] 4,398,902

[45] Aug. 16, 1983

[54] METHOD OF MAKING CONTAINER WITH HINGED COVER

[75] Inventor: Robert J. Mangum, Pearl, Miss.

[73] Assignee: Weyerhaeuser Company, Tacoma, Wash.

[21] Appl. No.: 374,651

[22] Filed: May 3, 1982

Related U.S. Application Data

[62] Division of Ser. No. 166,854, Jul. 8, 1980, abandoned.

[51] Int. Cl.[3] ..... B31B 17/00

[52] U.S. Cl. ..... 493/102; 493/151; 206/326

[58] Field of Search ..... 493/102, 151, 169, 139, 493/84, 114, 128; 206/326; 229/44 R, 45

[56] References Cited

U.S. PATENT DOCUMENTS

| | | | |
|---|---|---|---|
| 1,119,208 | 12/1914 | Weiss . | |
| 1,431,616 | 10/1922 | Wood | 229/44 R |
| 2,515,327 | 7/1950 | Bergstein | 229/44 R |
| 2,832,525 | 4/1958 | Cavin | 206/326 |
| 3,056,536 | 10/1962 | Smith et al. | 229/14 |
| 3,120,727 | 2/1964 | Ziliox | 493/102 X |
| 3,236,437 | 2/1966 | Johnson | 229/45 |
| 3,369,652 | 2/1968 | Bebout | 206/7 |
| 3,562,071 | 2/1971 | Rockefeller | 156/566 |
| 3,896,607 | 7/1975 | Royal | 493/102 X |
| 3,913,300 | 10/1975 | Benzing | 493/169 X |
| 3,941,303 | 3/1976 | Wilbur | 229/44 R |
| 3,978,982 | 9/1976 | Duncan | 206/326 |
| 3,995,539 | 12/1976 | Wallin et al. | 493/169 |
| 4,185,741 | 1/1980 | Schiff et al. | 206/326 |

*Primary Examiner*—James F. Coan

[57] ABSTRACT

A container and method of forming it. The container has four walls joined together along score lines, and a cover having a fastening panel, a fold-back panel, a cover panel and a front panel connected by score lines and side panels hingedly joined to said cover panel along score lines.

The cover is fastened to the upper edge of one wall at the fastening panel. The free edge of the fastening panel is aligned with the upper edge of the one wall, and one side edge of the panels having no side panels is aligned with the corresponding side edge of the one wall.

An alternate cover design has side panels hingedly connected to the front panel along score lines and a shelf panel hingedly connected to the front panel along a score line.

In the method of assembling the container, the free edge of the fastening panel is aligned with the upper edge of the wall, the side edge of the cover is aligned with the side edge of the wall and the fastening panel is fastened to the wall.

4 Claims, 12 Drawing Figures

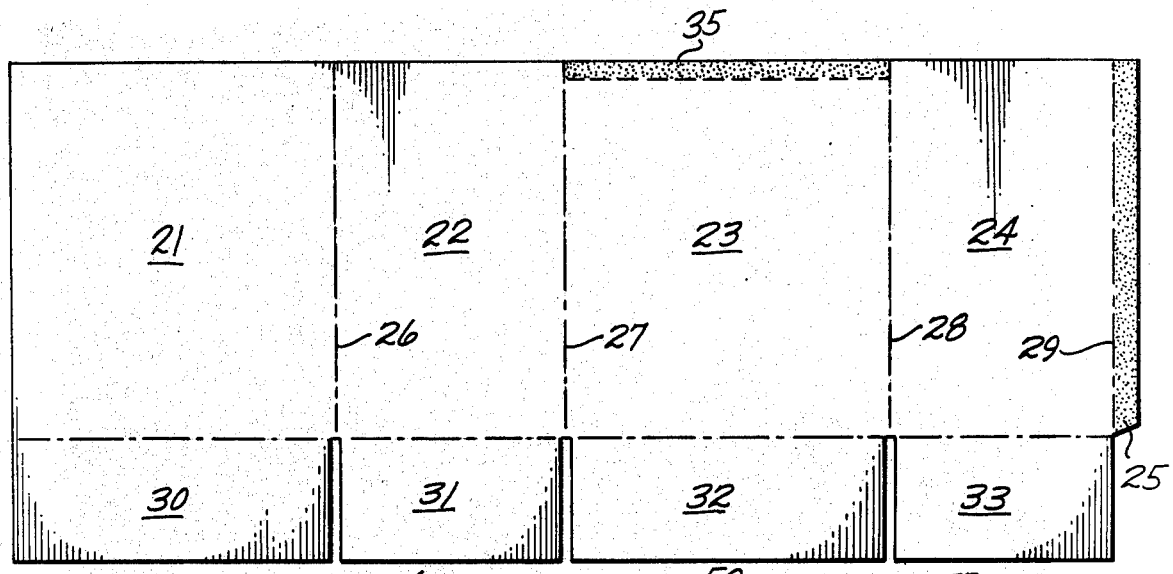
Fig. 1
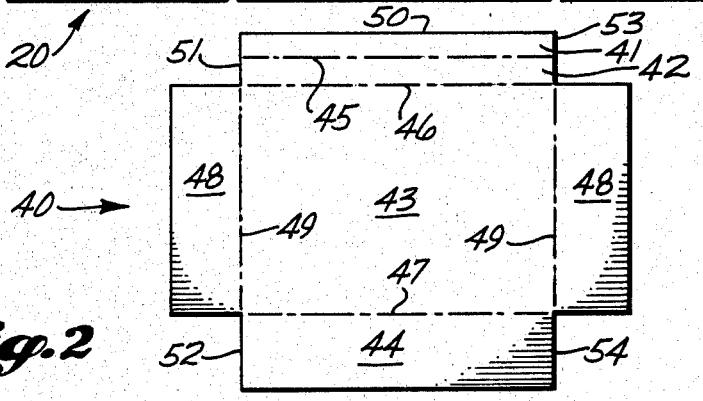
Fig. 2
Fig. 3
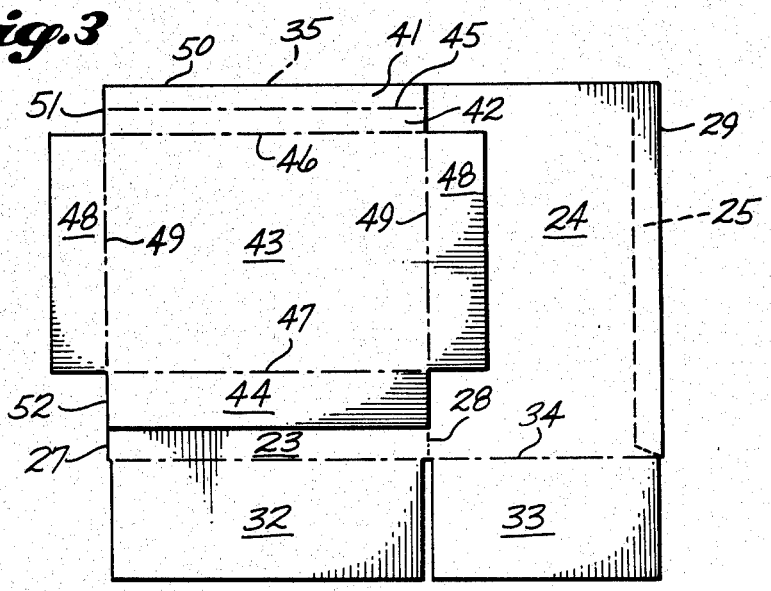

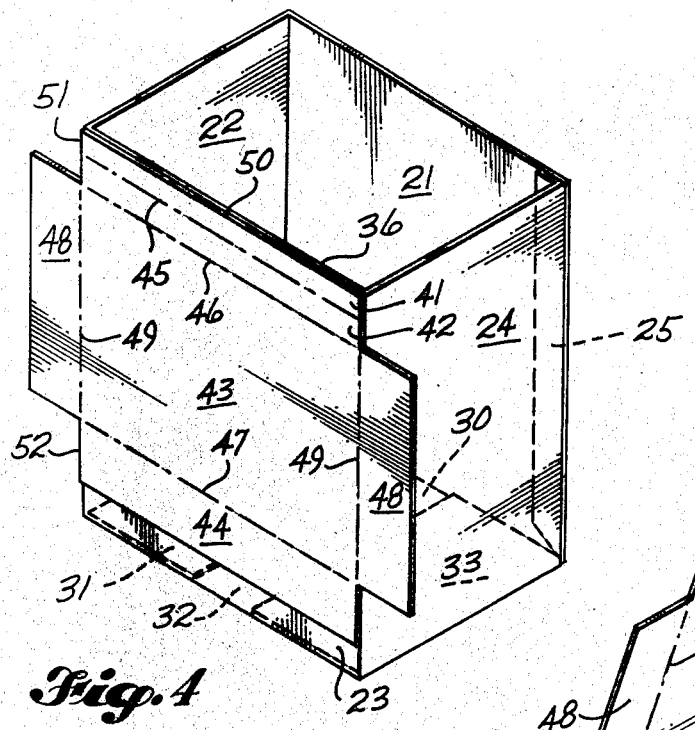
Fig. 4
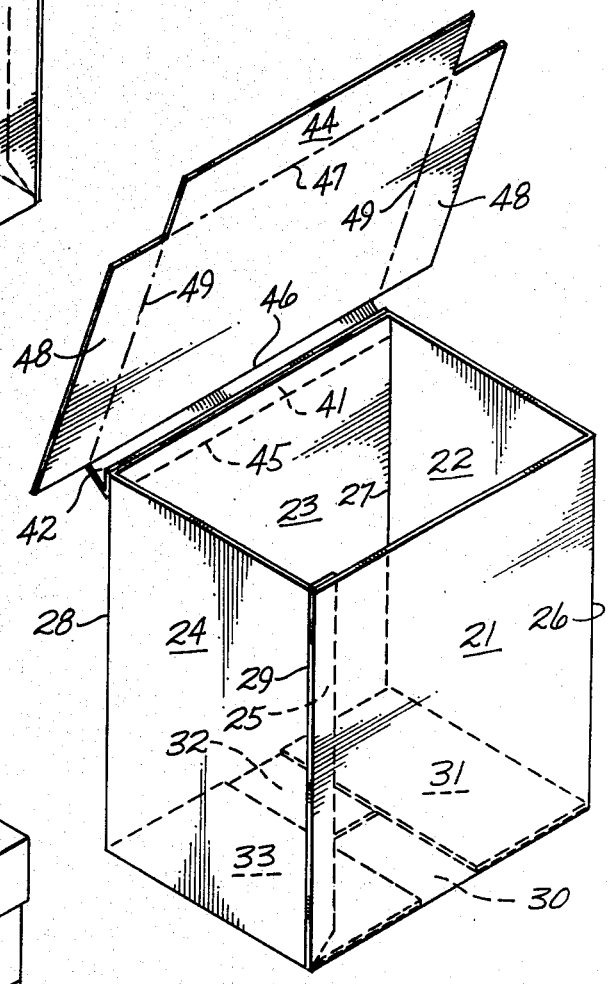
Fig. 5
Fig. 6
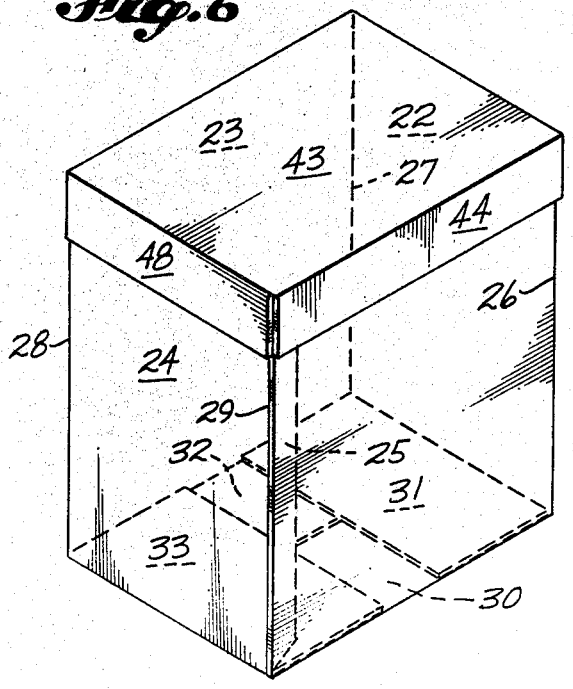

METHOD OF MAKING CONTAINER WITH HINGED COVER

This application is a division of application Ser. No. 166,854, filed July 8, 1980, and now abandoned.

BACKGROUND OF THE INVENTION

1. Field of the Invention

A container having a hinged lid and a method of manufacturing the container.

2. The Prior Art

There are a number patents that have flanged hinged lids. Weiss U.S. Pat. No. 1,119,208, issued Dec. 1, 1914 discloses a number of container constructions in which the four-piece lid is flanged and stapled to the container body. FIG. 2 of this patent discloses separate hinged cover elements which have portions 13 overlapping the end edges of the sides and a fold 15 extending under the overlapping portion 13. Both the portions 13 and fold 15 are stapled to the container body by staples 14. The patent also discloses constructions in which the sides of the container are folded over underneath the cover elements.

Smith, et al, U.S. Pat. No. 3,056,536, issued Oct. 2, 1962, discloses a container in which the cover hinged is flanged internally of the container. This is best shown in FIG. 5.

Bebout, U.S. Pat. No. 3,369,652, issued Feb. 20, 1968, discloses a container in which the hinged cover elements are formed by the body and are folded back to form flanges on the upper edge of the container.

Wilbur, U.S. Pat. No. 3,941,303, issued Mar. 2, 1976, discloses a similar construction.

Rockefeller, U.S. Pat. No. 3,562,071, issued Feb. 9, 1971, discloses an apparatus for attaching a carton to a card.

SUMMARY OF THE INVENTION

The purpose of the present invention is to make large containers, such as those used to pack furniture, using a minimum of board. These containers usually have a unitary hinged cover. To make the container and cover from a single sheet of corrugated would cause a great waste of board. Consequently, they must be made in two sections, a separate body and cover.

It is necessary to align the cover and the container body so that the cover will fit properly on the container when the container is closed. In the prior art this was usually a hand operation in which a score line on the cover was aligned with the upper edge of the container body and then stapled to the container body. This required a great deal of time to attain the appropriate alignment.

Another problem is illustrated by the Weiss patent. The containers are normally shipped in a lay-flat condition from the box plant to the customer. If the cover extends outwardly from the container body as it would in Weiss, then additional room is required for the container during shipment and storage.

The inventor decided there must be a way of easily aligning the hinged cover with the container body. In solving this problem he also created a container that was compact for shipment and storage and had greater strength at the cover hinge.

He created a container in which the cover is attached to the sidewall of the container by a fastening panel adhered to the upper edge of the container body. The hinged cover also overlies the container body during manufacture, transportation and storage. In addition, the hinge forms a three-ply flange along the upper edge of the container providing greater strength to the container. The container is formed by aligning the upper edge of the container body with the free edge of the fastening panel and the side edge of the container wall with the side edge of the cover fastening panel and front panel.

BRIEF DESCRIPTION OF THE DRAWINGS

FIG. 1 is a top plan view of the blank for the container body.

FIG. 2 is a top plan view of the blank for the container cover.

FIG. 3 is a top plan view of the assembled lay-flat container.

FIGS. 4–6 are isometric views of the container showing the cover being folded over the top of the container.

DESCRIPTION OF THE PREFERRED EMBODIMENTS

Figure 7:
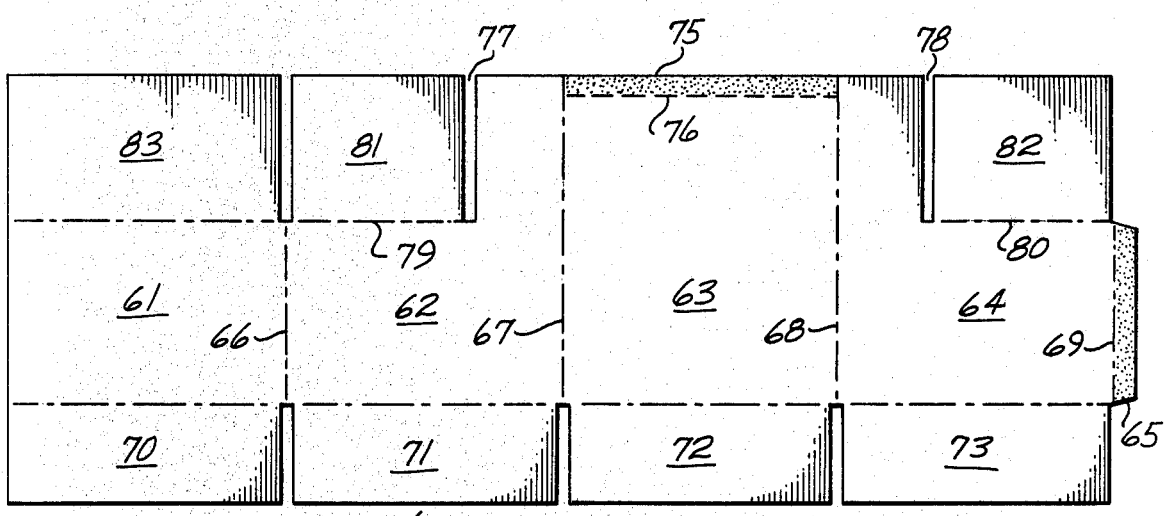
FIG. 7 is a top plan view of a blank for a furniture container body.
Figure 8:
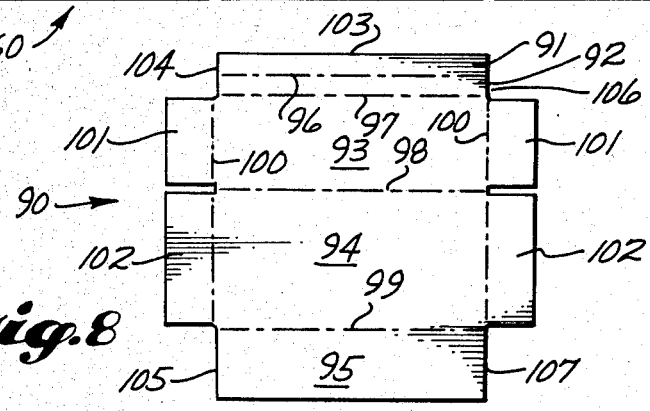
FIG. 8 is a top plan view of a blank for the furniture container cover.
Figure 9:
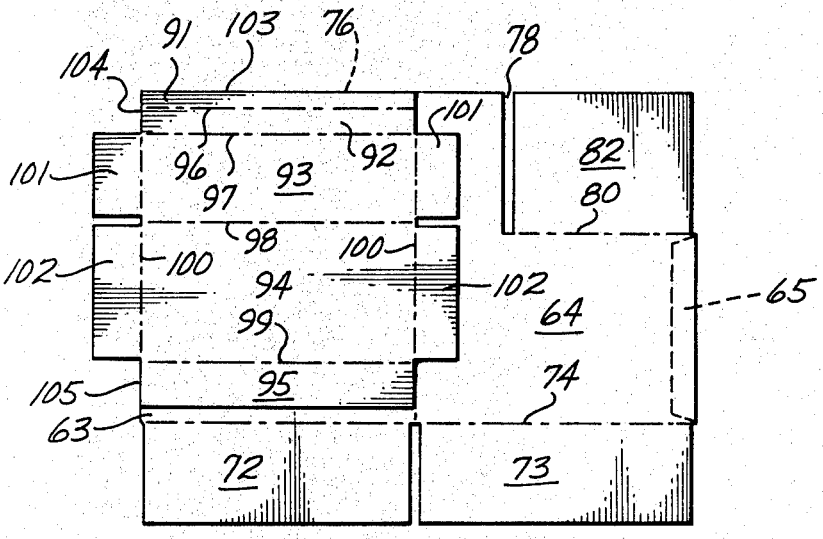
FIG. 9 is a top plan view of the assembled lay-flat container.
Figure 10:
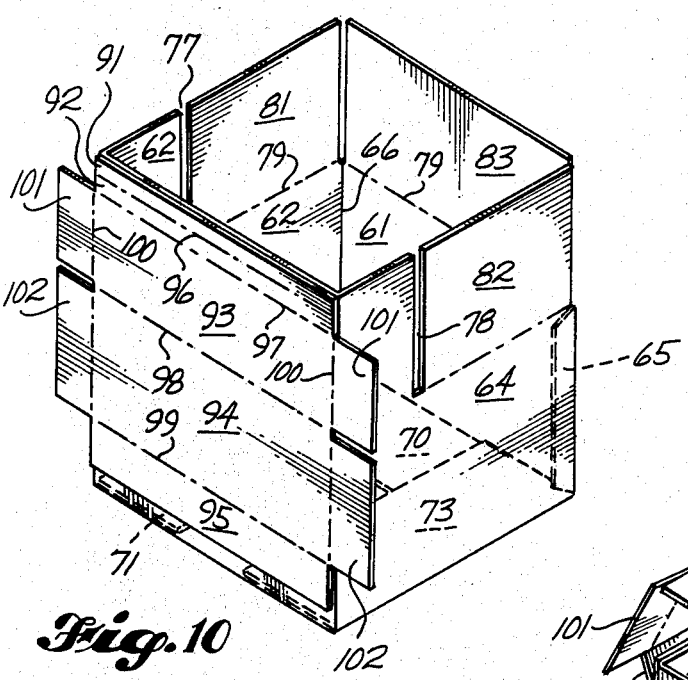
FIGS. 10–12 are isometric views of the container showing the cover being folded over the top of the container.
Figure 11:
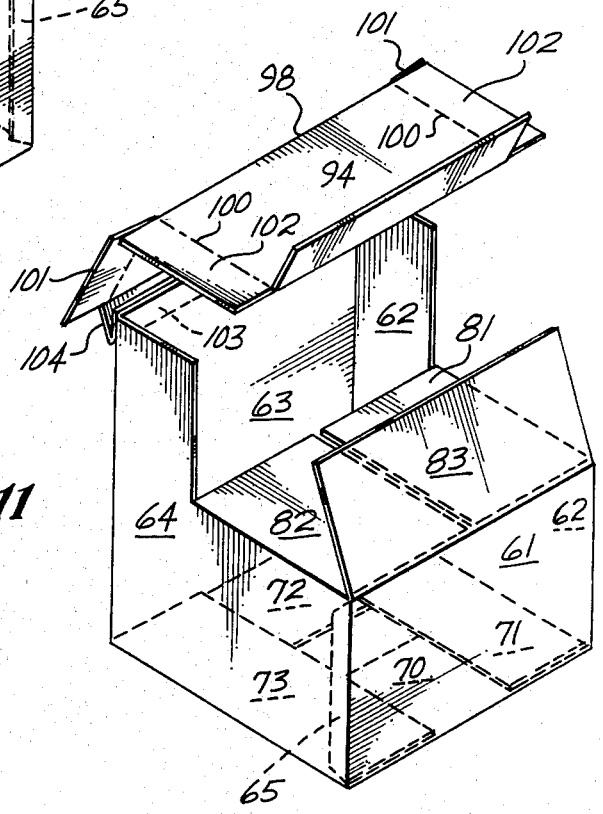
Figure 12:
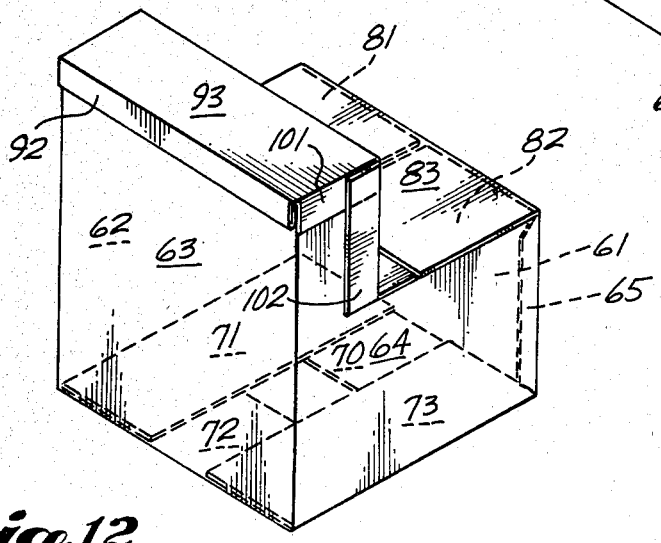

The blank for the container body is shown in FIG. 1. The blank 20 is divided into side walls 21, 22, 23 and 24 and glue flap 25 by score lines 26, 27, 28 and 29. The bottom flaps 30, 31, 32 and 33 are connected to the respective side walls 21-24 along score line 34. Along the upper edge 35 of wall 23 is a glue strip area 36.

The blank for the hinged cover is shown in FIG. 2. The blank 40 is divided into a fastening panel 41, a fold-back panel 42, a cover panel 43 and a front panel 44 by score lines 45, 46 and 47. Side panels 48 are attached to cover panel 43 along score lines 49. The side edge 51 of panels 41 and 42 and the side edge 52 of panel 44 are in substantial alignment with one score line 49, and the side edge 53 of panels 41 and 42 and the side edge 54 are in substantial alignment with the other score line 49.

In forming the container body adhesive is placed along glue flap 25 and the flap is adhered to the interior of side wall 21 to form a lay-flat container body. This is normally done by first rotating the wall 24 around score line 28 and then rotating the wall 21 around score line 26 so that the wall 21 overlies the glue flap 25 and is adhered to it. In the present application it is shown as being done by folding glue flap 25 around score line 29 and then folding walls 21 and 22 around score line 27 to adhere glue flap 25 to wall 21. In either instance there will be a side edge on wall 23. In the former case it will be score line 28; in the latter case it will be score line 27.

In fastening the cover to the body, adhesive would normally be placed on the fastening panel 41 although it could be placed on glue strip 36 of the wall 23. The hinged cover is aligned with the container body. The alignment may be done either by jigs or machine. In either instance the outer edge 50 of the cover is aligned with upper edge 35 of wall 23, and the side edge 51 of the panels 41 and 42 and side edge 52 of the front panel 44 are aligned with the score line 27. The fastening panel 41 is adhered to the wall 23 at glue strip 36. If the score line 28 is the side edge, the alignment would be of side edges 53 and 54 of the cover with the score line 28.

In erecting the container, the container body is set upright and the bottom panels folded inwardly in the usual manner to form the container bottom. The hinged cover is bent upwardly around score line 45 forming a three-layer construction at the fastening panel of the cover. The cover panel 43 is placed over the top of the container and the front panel 44 and side panels 48 are fastened to the container.

FIG. 7 shows the blank for an L-shaped furniture container body. The blank 60 is divided into front wall 61, side wall 62, back wall 63 and side wall 64 and glue flap 65 by score lines 66, 67, 68 and 69. The bottom flaps 70, 71, 72 and 73 are connected to walls 61-64 respectively along score line 74. Along the upper edge 75 of back wall 63 is a glue strip area 76. The L-shaped side walls 62 and 64 have vertical slots 77 and 78 and aligned horizontal score lines 79 and 80. The vertical slots 77 and 78 define the upright section of the container, and the horizontal score lines 78 and 80 define the shelf section of the container. Side shelf panels 81 and 82 are hingedly connected to side walls 62 and 64 respectively by the score lines 79 and 80. The score line 79 also extends across the front wall 61, and the front shelf panel 83 is hinged to front wall 61 at the score line 79.

The blank for the cover is divided into a fastening panel 91, a fold back panel 92, an upper cover panel 93, a front cover panel 94 and a front panel 95 by score lines 96, 97, 98 and 99. Score lines 100 connect top side panels 101 with upper cover panel 93 and front side panels 102 with front cover panel 94. The side edge 104 of panels 91 and 92 and the side edge 105 of panel 95 are in substantial alignment with one score line 100, and the side edge 106 of panels 91 and 92 and the side edge 107 of the panel 95 are in substantial alignment with the other score line 100.

The container is formed in the manner described before. The body is formed by adhering glue flap 65 to the interior of front panel 61. The cover is aligned with the container body. The free edge 103 of the fastening panel is aligned with edge 75 of the back wall and the side edge 104 of the fastening and fold-back panels 91 and 92, and side edge 105 of the front panel 95 are aligned with score line 67. The fastening panel 91 is adhered to the glue strip 76 of the back wall 63. If the score line 68 is the side edge of the back wall, then the side edges 106 and 107 would be aligned with the score line 68.

In erecting the container the front shelf is formed by bending down the side flaps 81 and 82 and front flap 83. The cover is folded upwardly around score line 96 to form the triple thickness section at the fastening panel. The upper cover panel 93 is placed over the top of the container, the front cover panel 94 is placed against the front of the upright section of the container, and the front panel 95 is placed over the flaps 81 and 82. The top side panels 101 are bent downwardly and fastened to the side walls and the front side panels 102 are bent inwardly and fastened to the side walls and top side panels.

What is claimed is:

1. The method of forming a lay-flat container having a separate hinged cover fastened to a container body, said container body comprising four walls serially joined together along a first set of score lines, said first set of score lines defining the side edges of said walls, each of said walls having an upper free edge, said cover comprising a fastening panel, a fold-back panel, a cover panel and a front panel serially connected by a second set of of score lines, and side panels only on said cover panel, hingedly joined to said cover panel along a third set of score lines, said fastening panel and said front panel having a free end edge, said fastening panel, said fold-back panel and said front panel having first free side edges, said first free side edges on each side of said fastening, fold-back and front panels being in substantial alignment, said side panels having second free side edges which do not extend beyond said cover panel, said method comprising bending one wall and its adjacent wall around the one score line between them so that said one score line becomes a free side edge of said one wall, placing said cover on the outer face of said one wall, aligning the free end edge of said fastening panel with the upper free edge of said one wall, aligning the corresponding first free side edge of said fastening, fold-back and front panels with said one side edge of said one wall and fastening said fastening panel to said one wall at said wall upper edge.

2. The method of claim 1 in which said cover is fastened to said body by adhesive.

3. A method of forming a lay-flat container having a separate hinged cover fastened to a container body said body comprising four walls serially joined together along a first set of score lines, said first set of score lines defining the side edges of said walls, said container walls comprising a front wall, an opposed back wall and two opposed L-shaped side walls extending between said front and back walls, said back wall and said side walls having upper sections and lower sections, the upper sections of said side walls and said back wall defining an upright section of said container, and said front wall and the lower sections of said side wall defining a shelf section of said container, said upper edge of said L-shaped side walls comprising substantially aligned upper section upper free edges and substantially aligned lower shelf section upper edges, said back wall having an upper free edge, said back wall upper free edge being substantially aligned with said side wall upper section free edges, said upper edge of said front wall being substantially aligned with said side wall lower shelf section upper edges, shelf panels hingedly connected to said side wall lower shelf section upper edges and said upper edge of said front wall along substantially aligned score lines, said cover comprising a fastening panel, a fold-back panel, an upper cover panel, a front cover panel and a front panel serially connected by a second set of score lines, and side panels being hingedly connected only to said upper cover panel and said front cover panel along a third set of score lines, said upper cover panel side panels and said front cover panel side panels being separated by a notch aligned with said score line between said upper cover panel and said front cover panel, said method comprising bending said back wall and its adjacent side wall around one score line between them so that said one score line becomes a free side edge of said one wall, placing said cover on the outer face of said one wall, aligning the free end edge of said fastening panel with the upper free edge of said back wall, aligning the corresponding side edge of said fastening, fold-back and front panels with said one side edge of said back wall and fastening said fastening panel to said back wall at said back wall upper edge.

4. The method of claim 3 in which said cover is fastened to said body by adhesive.

* * * * *